United States Patent [19]

Lillo

[11] 4,437,694

[45] Mar. 20, 1984

[54] SLIDING DOOR WITH SECURITY APPARATUS

[76] Inventor: Renaldo C. Lillo, 4415 Wright Ave., Racine, Wis. 53405

[21] Appl. No.: 353,845

[22] Filed: Mar. 1, 1982

[51] Int. Cl.[3] ..... E05C 3/04

[52] U.S. Cl. ..... 292/235; 292/DIG. 46

[58] Field of Search ..... 292/235, DIG. 46, DIG. 47, 292/DIG. 36, 79, 238, 230, 338, 231

[56] References Cited

U.S. PATENT DOCUMENTS

| | | | |
|---|---|---|---|
| 764,305 | 7/1904 | River | 292/235 |
| 1,002,812 | 9/1911 | Moore | 292/338 |
| 1,032,595 | 7/1912 | Franklin | 292/338 X |
| 3,328,920 | 7/1967 | Cohen et al. | 292/DIG. 46 |
| 3,825,290 | 7/1974 | Messina et al. | 292/262 |
| 4,073,522 | 2/1978 | Tierney | 292/262 |

*Primary Examiner*—Richard E. Moore

*Attorney, Agent, or Firm*—Arthur J. Hansmann

[57] ABSTRACT

A security apparatus for patio-type sliding doors, including a security bar with a roller that rides on the door panel frame. A stop positions the bar in the secure position, and the bar can be positioned in the inoperative position from outside the door, when first opened from the inside and when desired. Also, the bar can be positioned in automatic secure position after the door is opened only part way.

6 Claims, 2 Drawing Figures

SLIDING DOOR WITH SECURITY APPARATUS

This invention relates to a sliding door with security apparatus, and, more particularly, it relates to the well-known type of patio sliding doors and to the securing of those doors in a non-sliding or closed position.

BACKGROUND OF THE INVENTION

It is common knowledge that sliding doors, such as those of the patio type, are popular in domestic housing, but they are notoriously vulnerable for failing to provide a secure or burglar-proof type of door. These sliding doors are commonly mounted on a slide track, and there may be one or two sliding panels in the door. It is ordinary and known practice to place a stick or a bar against one of the doors and against a permanent stop, such as the door frame, to prevent the door from sliding along its track. However, with that arrangement, the user must remember to place the stick or bar in its secure position in the path of the door to prevent the sliding of the door, and, the user must also provide some other or additional type of means for preventing the sliding of the adjacent panel, in the installation where two panels slide on the track. One reason why a stick or bar is used to be jammed into the path of the sliding panel, as mentioned above, is that the latch or lock, if any, employed on sliding doors is not sufficiently sturdy to be a good burglar prevention.

The prior art is already aware of some apparatus for securing sliding doors, and U.S. Pat. Nos. 3,825,290 and 4,073,522 show the certain apparatus for that purpose. The disclosures of those patents differ from the present invention in that the first patent requires at least two bars which are hinged together and are also hinged at the opposite or free ends of the extending pair of bars. Further, in order to open a sliding panel in that arrangement, one must be lifting the hinge bars at the same time that one is pulling on the sliding panel, in order to release the hinge bars and move the panel. Still further, that arrangement requires a very firm center hinge connection in order to avoid having the hinge bars deflect and strike the glass immediately adjacent to the hinge of the pair of hinged bars when the force is applied on the sliding panel to open it. Likewise, the second mentioned U.S. Patent has similar deficiencies, and it only adds a complicated foot type of release for the hinged bar shown in that patent.

The present invention improves upon the prior art, including that mentioned above, in that it provides for a single type of security bar which is hinged at one end and which has a roller at the other end, all for extending between a stationary point and the edge of the sliding panel to preclude sliding movement when the bar is in its lowered or horizontal position.

Still further, the present invention provides an inoperative position which permits the security bar to be placed out of the way so that the panel can open and close to its full positions but without the security bar holding the panels closed once the panel is slid to the closed position.

Still further, the present invention provides a security apparatus which is made of only several parts and which leaves the glass in the sliding door or panels in a safe and secure position without jeopardizing the breakage or cracking of the glass by the impact of the parts of the security mechanism.

Still further, the present invention provides a means for releasing the secure position of the security bar and with that means being controlled from a location adjacent the handle utilized for pulling the sliding panel to the open position. With that arrangement, the user can conveniently pull the panel open and also release the security bar from one position and need not be required to stretch several feet from the door handle to a position of endeavoring to release a security member. The latter comment is also again significant with respect to the aforesaid two patents where the user must perform the two functions at two remote locations and do so simultaneously.

Still another object of this invention and an advantage with respect to the prior art is that the security apparatus of this invention can be readily and easily applied to sliding doors which are already installed, and no specially arranged sliding door or track is required in order for the security apparatus to be installed and utilized.

Other objects and advantages will become apparent upon reading the following description in light of the accompanying drawings.

DETAILED DESCRIPTION OF THE PREFERRED EMBODIMENT

Figure 1:
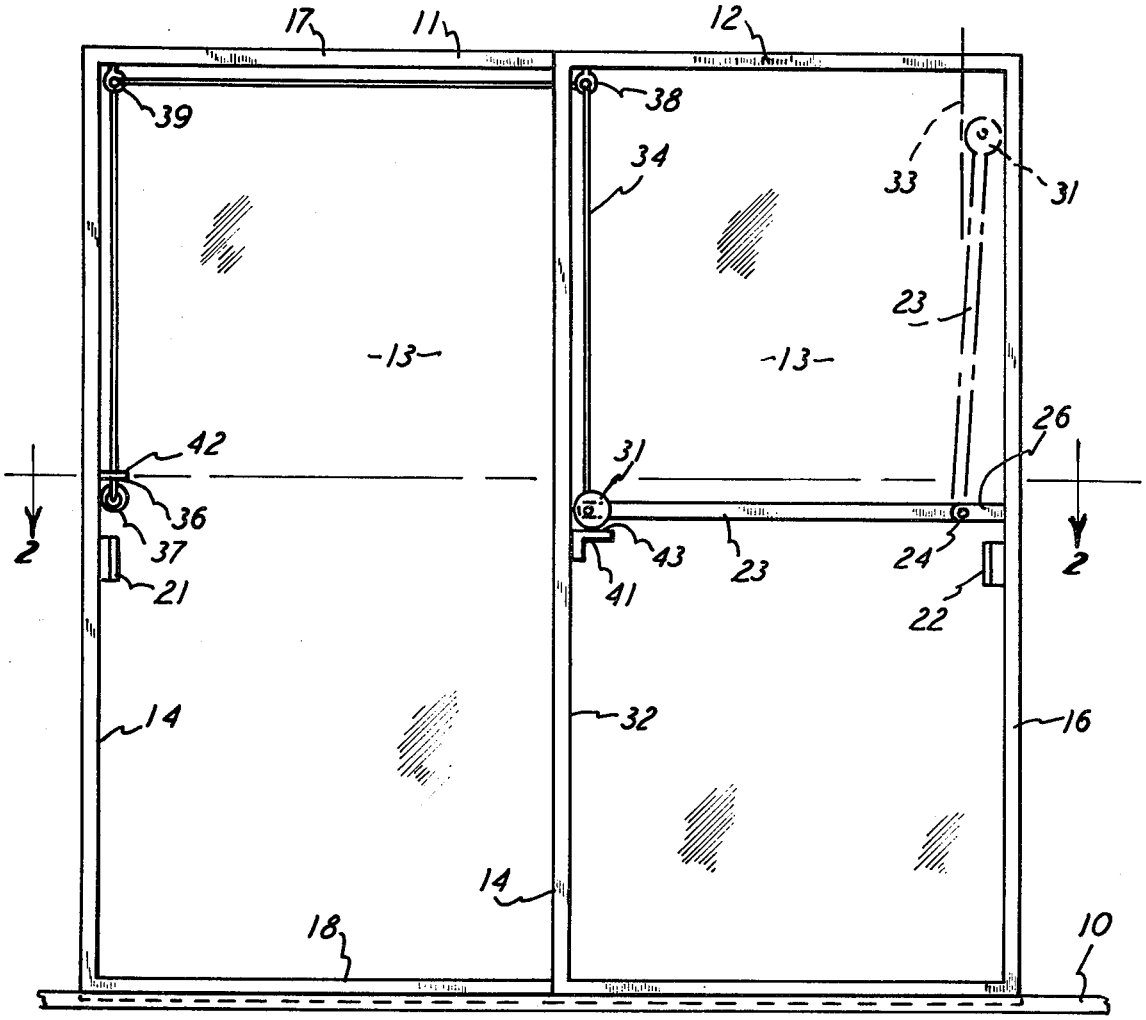
FIG. 1 is a front elevational view of a preferred embodiment of this invention.

The drawings show the usual and well known type of double-panel sliding doors, such as the popular patio doors, which are used in domestic or like buildings. The usual door track 10 is on the floor or ground extends horizontally and upwardly supports the two conventional sliding panels 11 and 12, each of which is provided with glass or light-transparent material 13. Thus, each panel 11 and 12 includes the two upright sections 14 and 16 and the two interconnecting and horizontal top section 17 and bottom section 18. The sections 14, 16, 17 and 18 form the rectangular frame of each panel 11 and 12 and of course the frame holds and supports the glass or transparent material 13. Further, the track 10 is of a sufficient width, as shown in FIG. 2, to support the panels 11 and 12 in a horizontal sliding mode, and the track 11 has guides 19, in the form of tongue-and-groove arrangement before engaging the panel bottom rails or frames section 19 in the usual sliding support of the panels 11 and 12. FIG. 2 further shows that the panels 11 and 12 are slightly off-set and thus slide parallel to each other and both panels 11 and 12 can move and therefore fully occupy the position protected by the opposite panel, as viewed in FIG. 1, for instance.

The aforementioned is of a conventional sliding door arrangement where both panels 11 and 12 are slidable for their full width, and conventional handles 21 and 22 are available for assisting and pulling on the respective panels for sliding them on the track 10, in the conventional arrangement. Of course there would also be the usual locks or latches (not shown) adjacent the handles 21 and 22 for latching the panels against the door frames (not shown).

The security apparatus of this invention supplements the conventional sliding door arrangement shown and described, and it includes a security bar 23 pivoted or hinged on a pin 24 supported on a bracket 26. The bracket 26 is suitably secured to the panel upright 16, such as by bolting which is not shown, but any conventional means for readily attaching to the panel 12 at its upright 16 is intended. The bracket 26 is shown in FIG. 2 to be U-shaped and carries the hinge axis 24 in the horizontal direction shown, and the bracket extending legs 27 are thus available for lateral guiding of the hinge bar 23 so that the bar projects directly in the plane of the U-shaped bracket 26 and thus is always in the plane of the sliding panel 11, as shown.

The extending end 28 of the security bar 23 carries a pin axel 29 on which a roller or wheel 31 is rotatably mounted and is of a size sufficient to extend into contact with the surface 32 of the panel upright 16 of the panel 11, as shown in the drawings. That is, the security bar end 28 is slightly clear of the upright 16, but the roller 31, being mounted on the axel 29 and being of a sufficient diameter, extends into contact with the surface 32 when the security bar is in its down and secured position which is the horizontal position shown in the drawings. Therefore, the total length of the security bar 23 between its pins 24 and 29 and the radius of the roller 31 and the portion of the bracket 26 to the right of the hinge pin 24 all present a length sufficient to span between the uprights 16 of the two panels 11 and 12 for the secured position shown. In that position, the panel 11 cannot be pulled to the open or to the right, as viewed in the drawings, and, likewise, the panel 12 cannot be pulled to the open position or to the left, as viewed in the drawings. Therefore, the two panels are held in the secured position by the security bar 23 and the parts attached thereto, as described.

Figure 2:
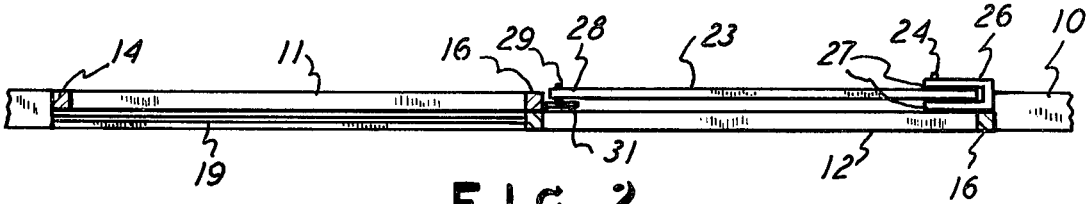
FIG. 2 is a sectional view taken along the line 2—2 of FIG. 1.

When it is desired to open either panel 11 or 12, the user will simply raise the security bar free end 28 to a position only slightly above the shown position for the roller 31, and that will permit either panel 11 or 12 to slide toward the other while the roller 31 simply rolls along the surface 32 and moves upwardly thereon and, in the extreme position, can move to the dot-dash line position shown in FIG. 1 which would be the unlocked or non-secured position.

Further, the dot-dash line position shows that the security bar 23 and the rollers 31 are in an over-center position relative to the plane of the hinge axis 24, and that plane is defined by the vertical dot-dash line designated 33. In that over-center position, the two panels 11 and 12 can be freely moved between their door closed position shown and the open position where either panel is slid adjacent the other panel for opening either panel. Therefore, one could actually place the bar 23 and roller 31 into the non-secured or shown dot-dash line position of FIG. 1, either by sliding the doors toward each other or by manually raising the bar 23 while one is on the inside of the doors, and the doors can then be slid between the closed and opened positions from either the inside or the outside and that opening and closing can be continuous until the security bar 23 is again placed into its downward or horizontal and full-line secured position shown in FIG. 1.

Further, one can release the bar 23 and the roller 31 from the downward or secured position by means of a remote control release means, rather than by directly touching the bar 23, and that remote control means can be operated from a location immediately adjacent to the door handle 21, for instance. Therefore, a flexible line or cable 34 has one end connected to the security bar end 28, and the cable 34 has its other end 36 located adjacent the door handle 21. Therefore, one can even simultaneously grasp the handle 21 and also finger the table end 36, such as through the ring 37 on the cable 34, and therefore pull on the cable 34 and thereby lift the bar end 28 to release the security bar 23 from its secure position and thereby permit the panel 11 to be opened or slid. The drawings further show that the cables 34 may be strung through eyelets 38 and 39 sufficiently attached to the panel members 17, for instance, and thus the cable 34 is strung out of the view through the glass 13 and out of the way of the opening when the door is opened, since the cable 34 can move with the sliding doors. Further, the cable 34 is of a sufficient flexibility and length to permit the security bar 23 to move to its non-secure or dot-dash line position shown in FIG. 1.

In order to establish the secured or horizontal position for the bar 23, a stop 41 is shown attached to the upright 16 of the panel 11 and in the path of the roller 31 to provide an upward support for the roller 31 and thus positioned the bar 23 in the horizontal position. Therefore, the roller 31 will always roll along the surface 32 and down onto the stop 41 to establish the secured or horizontal position for the bar 23. Alternatively, the cable 34 could have a eyelet or the like 42 which would prevent the cable 34 from permitting the roller 31 to move downwardly beyond the horizontal position in the event that the stop 41 were omitted. In that instance, the cable 34 itself would hold the roller 31 in the horizontal or secured position and that would serve as the stop means and the actual shown stop 41 could be omitted.

Therefore, the two panels 11 and 12 are slidable in the longitudinal plane of the track 10, in the conventional manner, and the panel upright 16 can serve as an upright member on which the bracket 26 and thus the security bar 23 is mounted. Of course the bracket 26 could also be mounted on an adjacent frame, but, in that instance, it would then not serve as security for the sliding panel 12, in the event there is the two sliding panels as shown herein. Further, the location of the stop 41 and the diameter of roller 31 and the location of the hinge 24 are all arranged so that the stop-resting surface 43 is at an elevation below the elevation of the hinge axis 24, and thus the secured and horizontal position of the bar 23 is established. When either panel 11 or 12 is slid only partly open, then the roller 31 will roll upwardly on the surface 32 to a position short of the vertical plane 33. In that event, when the panels are returned to their shown closed positions, the roller 31 will have resumed its shown secured position in the drawings. Thus, there is an automatic securing arrangement.

What is claimed is:

1. A sliding door with security apparatus, comprising a sliding door track, a sliding door panel slidably mounted on said track in the longitudinal plane of said track, an upright member spaced from said sliding panel and on said longitudinal plane, a security bar hingedly mounted on said upright member and extending toward said sliding panel and with the hinge axis being in the path of sliding movement of said sliding panel and being horizontal for swinging movement of said bar in said plane, a roller rotatably mounted on the extending end of said bar and being located in rolling contact with said sliding panel for rolling along said sliding panel when said sliding panel is moved toward and away from said security bar while said security bar is undergoing its swinging movement, and a stop mounted on said sliding panel in the path of movement of said roller and at an elevation relative to the elevation of said hinge axis to upwardly support said security bar in a downwardly swung and thereby secured position for restraining said sliding panel against said sliding movement.

2. The sliding door with security apparatus as claimed in claim 1, wherein said stop is a roller abutment located at an elevation slightly lower than the elevation of said hinge axis, for upwardly supporting said roller when said security bar is in the downwardly swung position.

3. The sliding door with security apparatus as claimed in claim 1 or 2, including a lifter attached to said security bar for lifting said roller off said stop, for releasing said security bar from its secured position.

4. The sliding door with security apparatus as claimed in claim 3, wherein said lifter is a flexible line with one end attached to said security bar and the other end extending to a location remote from said security bar, for lifting said security bar into its non-secured position.

5. The sliding door with security apparatus as claimed in claim 1 or 2, including an abutment on said upright member and located on the swinging path of said roller and at an elevation above said hinge axis and to the side of said hinge axis away from said sliding panel, to thereby present an over-center position, and thereby an inoperative position, for said security bar when said security bar is swung upwardly to where said roller rests on said abutment.

6. The sliding door with security apparatus as claimed in claim 1 or 2, including an additional sliding panel slidably mounted on said door track and offset from the path of sliding movement of the first said sliding panel, and said upright member being a member on said additional sliding panel, whereby said security bar restrains both said panels from sliding toward each other.

* * * * *